US009290987B2

(12) United States Patent
Yeomans et al.

(10) Patent No.: US 9,290,987 B2
(45) Date of Patent: Mar. 22, 2016

(54) WINDOW FRAME WITH JAMB EXTENDER

(71) Applicants: Jason Gray Yeomans, Morehead City, NC (US); Robert Wayne Davis, Beaufort, NC (US)

(72) Inventors: Jason Gray Yeomans, Morehead City, NC (US); Robert Wayne Davis, Beaufort, NC (US)

( * ) Notice: Subject to any disclaimer, the term of this patent is extended or adjusted under 35 U.S.C. 154(b) by 0 days.

(21) Appl. No.: 13/856,028

(22) Filed: Apr. 3, 2013

(65) Prior Publication Data

US 2014/0123589 A1 May 8, 2014

Related U.S. Application Data

(60) Provisional application No. 61/621,605, filed on Apr. 9, 2012.

(51) Int. Cl.

| | |
|---|---|
| ***E04C 2/38*** | (2006.01) |
| ***E06B 3/70*** | (2006.01) |
| *E06B 3/82* | (2006.01) |

(52) U.S. Cl.

CPC ..... *E06B 3/7001* (2013.01); *E06B 3/822* (2013.01); *E06B 3/825* (2013.01); *E06B 2003/7063* (2013.01); *E06B 2003/7084* (2013.01); *Y10T 29/49826* (2015.01)

(58) Field of Classification Search

CPC ..... E06B 1/345; E06B 1/702; E06B 3/7001; E06B 2003/7084; E06B 3/825; E06B 3/822; E06B 2003/7063; Y10T 29/49826

USPC ..... 52/656.5, 204.54, 204.58, 762

See application file for complete search history.

(56) References Cited

U.S. PATENT DOCUMENTS

| | | | | |
|---|---|---|---|---|
| 1,622,022 | A | 3/1927 | Brennen | |
| 2,600,072 | A | 6/1952 | Peremi | |
| 2,651,814 | A | 9/1953 | Lester, Jr. | |
| 3,583,114 | A | 6/1971 | Belfor | |
| 4,328,644 | A * | 5/1982 | Scott et al. | 49/501 |
| 4,813,204 | A | 3/1989 | Rentschler | |
| 5,233,802 | A | 8/1993 | Rogers | |
| 5,345,722 | A | 9/1994 | McKann | |
| 5,791,104 | A | 8/1998 | Baier et al. | |
| 5,822,931 | A * | 10/1998 | Galowitz et al. | 52/204.5 |
| 5,857,299 | A | 1/1999 | Gyllenberg et al. | |
| 6,378,266 | B1 * | 4/2002 | Ellingson | 52/656.4 |
| 6,389,763 | B1 | 5/2002 | Clauss | |
| 6,829,865 | B2 | 12/2004 | Smith | |
| 7,331,146 | B1 | 2/2008 | Beutler et al. | |
| 8,024,898 | B2 * | 9/2011 | Alvarado | 52/211 |
| 2003/0226321 | A1 * | 12/2003 | Engebretson | 52/204.54 |
| 2009/0077910 | A1 | 3/2009 | Gordon | |

* cited by examiner

*Primary Examiner* — Basil Katcheves
(74) *Attorney, Agent, or Firm* — MacCord Mason PLLC

(57) ABSTRACT

A window assembly is described for installation in window openings having different thicknesses. A window frame having parallel side jambs, a header and a sill having inner and outer edges, and forming a rectangular opening is provided. C-shaped clamps are attached to the inner faces of the jambs, header and sill. The clamps include inwardly extending inner and outer side arms spaced at a given width, and an inner side. A rectangular extender frame is formed of four rectangular boards having lengths corresponding to the lengths of the frame jambs, header and sill. The extender frame is inserted into the clamps and moved relative to the window frame until the combined thickness of the extender frame and window frame corresponds to the thickness of the opening into which the window frame is to be mounted. Extender trim can be added to hide the clamps.

8 Claims, 3 Drawing Sheets

WINDOW FRAME WITH JAMB EXTENDER

This application claims the benefit of and priority to the filing date of U.S. Provisional Application Ser. No. 61/621,605, filed May 9, 2012, the entire content of which is incorporated herein.

BACKGROUND OF THE INVENTION (1) Field of the Invention

The present invention relates generally to windows and window frames, and in particular to window frames that include jamb extenders so that the frames are suitable for installation into window openings having different thicknesses.

(2) Description of the Prior Art

When installing a prefabricated window assembly into wall opening, difficulties may be encountered because of variations in the thicknesses of walls. Specifically, the thickness of the rough framing around the window opening may be thicker than the window assembly, leaving a gap exposing the framing. Correction of this problem requires experienced trim carpentry to cover the gap, resulting in added time and cost.

SUMMARY OF THE INVENTION

The present invention addresses this problem by providing an adjustable jamb extender on one side of the window assembly. This jamb extender is adjustable to any position between a fully closed position and a fully extended position to cover any gap that may result for the rough framing, i.e., the wall, having a thickness greater than the window assembly thickness.

The window assembly modified by the present invention is comprised of a window frame and one or more window panels, e.g., sashes, installed within the frame. The frame is comprised of spaced parallel side jambs, a header or top jamb, and a sill. The components of the frame together form a rectangular opening into which the window panels are mounted. For example, the window panels may be upper and lower window sashes that are slidable mounted in vertical sash channels that are attached to the inner surfaces of the side jambs. The present invention is applicable to a wide variety of windows, and the structure of the window panels does not per se form a part of the invention.

The window frame components, i.e., the jambs and sill have inner and outer edges. In the present invention, the jamb extender assembly is attached to the inner faces of the window frame components. Specifically, the jamb extender assembly is comprised of extenders, extender clamps or continuous channel, and extender trim.

The extenders are comprised of four rectangular boards having a given width, inner and outer edges, and lengths corresponding to the lengths of the frame members. Specifically, there are two side extenders having lengths corresponding to the lengths of the side jambs, a top extender having a length corresponding to the length of the top jamb, and a bottom extender having a length corresponding to the length of the sill. The extenders are joined at their ends to form an open frame having an opening corresponding approximately to the opening of the window assembly.

The clamps are spaced along the inner edges of the window frame. Each clamp includes an opening away from the window frame and longitudinally aligned with the frame component on which it is mounted. The clamp openings are sized to receive an extender so that the extenders are fictionally held at desired positions by the clamps.

As shown in the preferred embodiment the clamps are C-shaped clamps or continuous C-shaped channel extending substantially the length of the jamb with a center section secured to the inner lace of a jamb, and parallel, outwardly extending side arms spaced at a distance corresponding to the extender thickness. The side arms may include inwardly extending gripping projections to aid in holding the extenders. Preferably, at least two clamps axe attached to the inner edge of each window frame component. For example, two clamps may be attached to the top jamb and to the sill, while three clamps are attached to the inner edge of each side jamb. However, the size of the window determines the number of clamps or the length of the channel used.

To attach the jamb assembly to the window assembly, the jamb assembly is simply placed over the clamps and pushing into the clamps until the combined widths of the frame assembly and extender assembly equals the thickness of the rough framing, thereby hiding any rough framing when the assembly is installed into the window opening. Any needed adjustment can be made pushing the jamb assembly further into the clamps, or further retracting the jamb assembly from the clamps.

To prevent the clamps and any gap between the window frame and the extenders from being visible, the extender assembly also includes extender trim pieces that are mounted to extend from the rear of the window frame along the inner sides of the clamps. The extender trim pieces are attached to the window frame and have a width greater than the height of the clamps. The outer edges of the extender trim pieces may include inner flanges extending over the clamp wall adjacent the trim piece to further hide the clamps.

After the window assembly is installed, exterior trim pieces may be added over the outer edges of the window frame and rough framing, and plasterboard or other covering may be added to cover the ends of the extenders and the rough framing.

Thus, the invention defines a method of modifying a rectangular window frame having parallel side jambs, a header and a sill, the side jambs, header and sill having inner edges to make the frame suitable for installation into window openings having different thicknesses, the method comprising the steps of forming a rectangular extender frame of boards having enter edges, the extender frame having a size corresponding to the size of the window frame; attaching inwardly opening C-shaped clamps onto the inner faces of the window frame jambs, header and sill, the C-shaped clamps having center sections attached to the inner faces of the jambs, header and sill, inwardly extending inner and outer side arms spaced at a given width, and an inner side; and inserting the outer edges of the extender frame boards into the C-shaped clamps so that the combined thickness of the window frame and extender frame corresponds to the thickness of the window frame opening into which the window frame is to be mounted. The method may further include the step of mounting extender trim on the inner edges of the jambs, header and sill, the trim extending along the inner sides of the clamps.

DETAILED DESCRIPTION OF THE INVENTION

Figure 1:
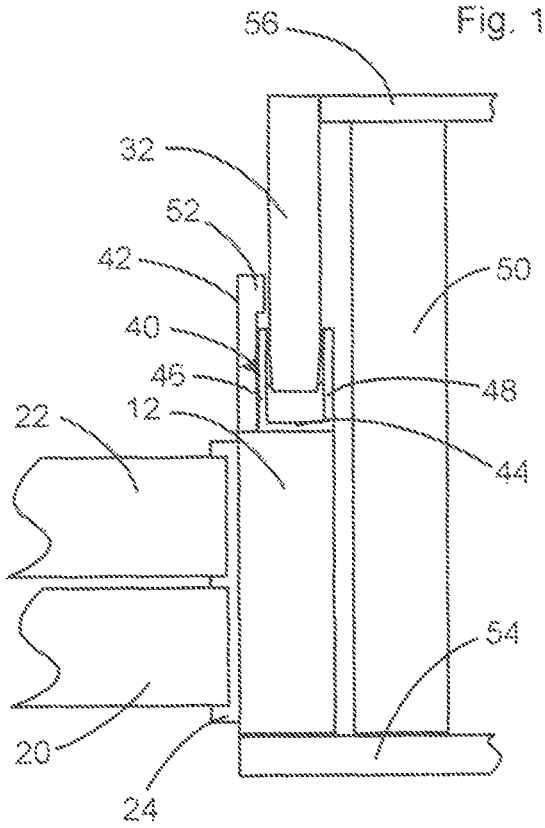
FIG. 1 is a sectional end view of the window frame and extender assemblies.
Figure 2:
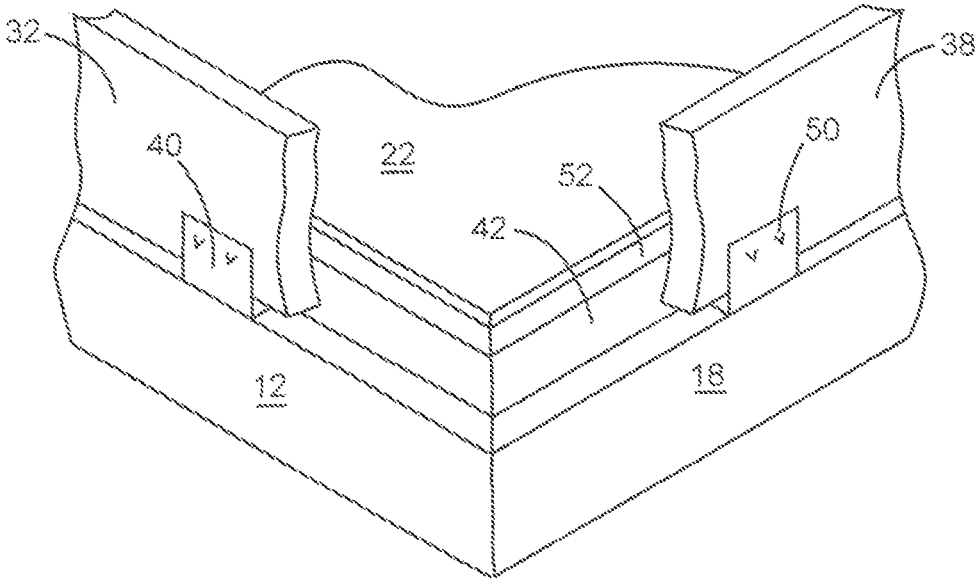
FIG. 2 is a perspective view of a section of the window frame and extender assembly with a plurality of clamps attached to each jamb.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As shown in the drawings, the present invention is a modification of a window assembly, generally 10, which is comprised of a window frame constructed of spaced parallel side jambs 12 and 14, a header jamb 16 and a sill 18. Upper and lower sashes 20 and 22 are mounted within the frame, e.g., with sash channels 24 attached to side jambs 12 and 14.

Jamb extender assembly, generally 30, of the present invention, is attached to the inner faces of jambs 12, 14 and 16, and sill 18. Jamb extender assembly 30 is comprised of extenders 32, 34, 36 and 38, extender clamps 40, and extender trim 42.

Extenders 32, 34, 36 and 38 are rectangular boards having a given width, inner and outer edges, and lengths corresponding to the lengths of the frame members. Specifically, side extenders 32 and 34 having lengths corresponding to the lengths of the side jambs 12 and 14, top extender 36 has a length corresponding to the length of top jamb 16, and bottom extender 38 has a length corresponding to the length of sill 18. The extenders are joined at their ends to form an open frame having an opening corresponding approximately to the opening of the window assembly.

Figure 3:
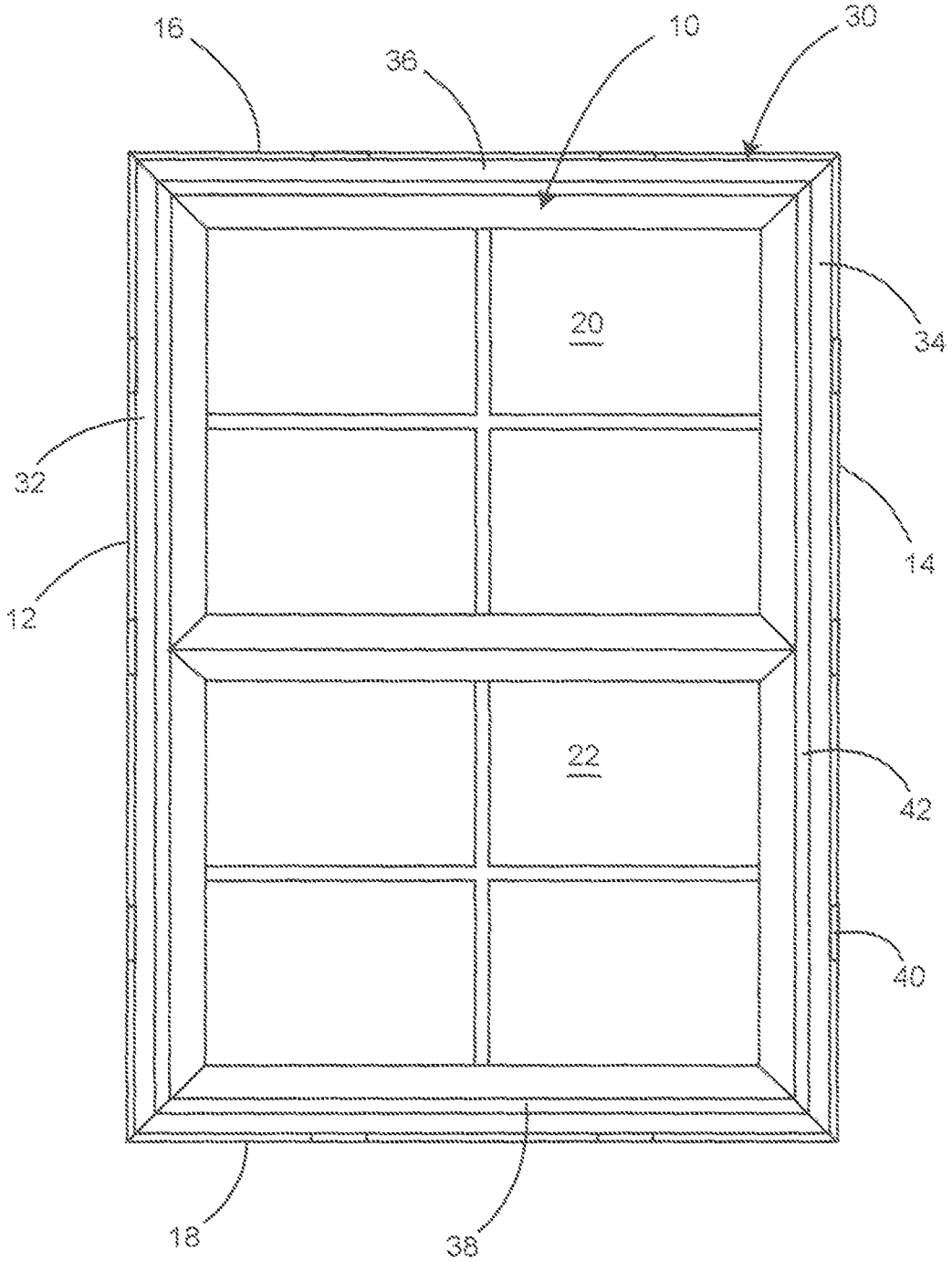
FIG. 3 is a plan view of the inner side of a window assembly with the extenders attached.

Clamps 40 are spaced along the inner edges of the jambs. Clamp 40 as shown in the preferred embodiment are C-shaped clamps with a center section 44 secured to the inner face of a jamb, and parallel, outwardly extending side arms 46 and 48 spaced at a distance corresponding to the extender thickness. Side arms 46 and 48 may include inwardly extending gripping projections 50 to aid in holding the extenders. As shown in FIG. 3, two clamps 40 are attached to top jamb 16 and to sill 18, while three clamps 40 are attached to each of side jambs 12 and 14.

To attach the jamb assembly, jamb extenders 32, 34, 36 and 38 are pushed into clamps 40 until the combined widths of the jambs and extenders equals the thickness of framing wall jack 50, thereby hiding framing when the assembly is installed. To hide clamps 40 and any gap between the jambs and extenders, extender trim 42 is mounted along the inner sides of clamps 40. The outer edges of the extender trim 42 may include inner flanges 52 extending over clamp wall 46 to further hide clamps 40. After assembly exterior trim pieces 54 and plasterboard 56 or other interior covering are added.

Figure 4:
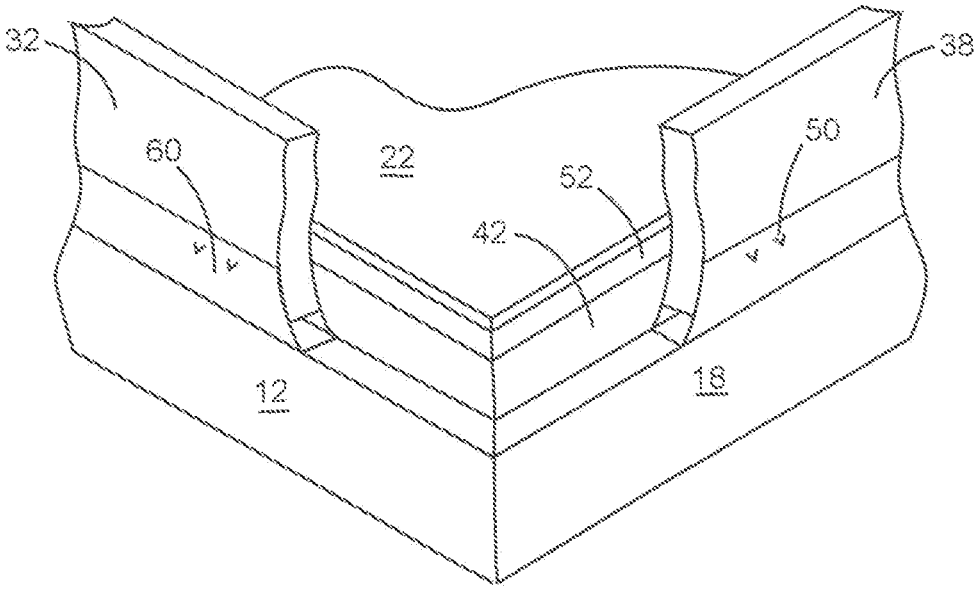
FIG. 4 is a perspective view of a section of a window frame and extender assembly with a single clamp or channel attached to each jamb.

FIG. 4 illustrates an alternative clamp 60, which extends substantially the length of the jamb, header or sill to which it is attached, thereby repairing only a single clamp for each side of the frame.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed is:

1. A window assembly for installation in window openings having different thicknesses comprising:

a) a window frame having parallel side jambs, a header and a sill, said jambs, header and sill having inner and outer faces and together forming a rectangular opening;

b) a plurality of C-shaped clamps extending inwardly from the inner edges of said window frame jambs, header and sill, said C-shaped clamps having center sections attached against the inner faces of said jambs, header and sill, parallel inwardly extending inner and outer side arms spaced at a given width, and an inner side, the inner side having a rectangular space defined by the inner and outer side arms each forming a 90 degree angle with respect to the center section, said C-shaped clamps including inwardly extending gripping projections along its inner and outer side arms;

c) a rectangular frame formed of four rectangular boards having lengths corresponding to the lengths of said frame jambs and widths corresponding to said given width, said rectangular boards having outer edges with a rectangular shape corresponding to the rectangular space of the inner side of the C-shaped clamps, said outer edges of rectangular boards being slidably adjustable in said clamps relative to said window frame; and d) a plurality of extender trim pieces forming an extender trim, said extender trim mounted on the inner edges of said jambs, header and sill and extending from the rear of said window frame along the inner sides of said clamps, said extender trim pieces flushly abutting the inner side of said clamps on one side and flushly abutting the inner edge of said jambs on another side of said extender trim pieces, said extender trim pieces having a width greater than the height of said clamps and including a flange over its outer edge extending over the inner sidewall of said clamps.

2. The window assembly of claim 1, further including at least one window pane within said window frame opening.

3. The window assembly of claim 1, wherein a plurality of C-shaped clamps extend inwardly from each of said jambs, header and sill.

4. The window assembly of claim 1, wherein a single C-shaped channel is mounted on the inner face of each frame jamb, header and sill.

5. The window assembly of claim 1, further including vertical sash channels attached to the inner surfaces of said side jambs and window sashes slidable within said channels.

6. A method of modifying a rectangular window frame having parallel side jambs, a header and a sill, said side jambs, header and sill having inner faces to make said frame suitable for installation into window openings having different thicknesses, said method comprising:

a) forming a rectangular extender frame of boards having outer edges, said extender frame having a size corresponding to the size of said window frame;

b) attaching inwardly opening C-shaped clamps onto the inner faces of said window frame jambs, header and sill, said C-shaped clamps having center sections attached against the inner faces of said jambs, header and sill, parallel inwardly extending inner and outer side arms spaced at a given width, and an inner side, the inner side having a rectangular space defined by the inner and outer side arms each forming a 90 degree angle with respect to the center section;

c) slidably inserting the outer edges of said extender frame boards into the rectangular space of said C-shaped clamps so that the combined thickness of the window frame and extender frame corresponds to the thickness of the window frame opening into which the window frame is to be mounted; and (d) mounting extender trim on the inner edges of said jambs, header and sill, said trim extending from the rear of said window frame along the inner sides of said clamps, said extender trim pieces flushly abutting the inner side of said clamps on one side and flushly abutting the inner edge of said jambs on another side of said extender trim pieces, said extender trim pieces having a width greater than the height of said clamps and including a flange over its outer edge extending over the inner sidewall of said clamps.

7. The method of claim 6, wherein a plurality of C-shaped clamps are attached to each of said jambs, header and sill.

8. The window assembly of claim 6, wherein a single C-shaped channel is attached to the inner face of each frame jamb, header and sill said channels extending substantially the lengths of the jambs, header or sill to which the channel is attached.

* * * * *

UNITED STATES PATENT AND TRADEMARK OFFICE

CERTIFICATE OF CORRECTION

PATENT NO. : 9,290,987 B2
APPLICATION NO. : 13/856028
DATED : March 22, 2016
INVENTOR(S) : Yeomans et al.

It is certified that error appears in the above-identified patent and that said Letters Patent is hereby corrected as shown below:

Specification

In Column 1, Line 66, there should be a "," after the word embodiment.

In Column 2, Line 38, --enter-- should be "outer".

Signed and Sealed this
Seventeenth Day of May, 2016

Michelle K. Lee

Michelle K. Lee
*Director of the United States Patent and Trademark Office*